United States Patent [19]

Yang

[11] 4,455,594

[45] Jun. 19, 1984

[54] EXTENSION, FOLDING OR DETACHABLE LAMP SHADE

[76] Inventor: Tai-Her Yang, 5-1 Tay Pyng St., Shi Hwu Jenn, Jang Huah Shiann, Taiwan

[21] Appl. No.: 471,530

[22] Filed: Mar. 2, 1983

[51] Int. Cl.[3] ..... F21P 1/00

[52] U.S. Cl. ..... 362/252; 362/217; 362/220; 362/277; 362/360; 362/362; 362/418; 362/427; 362/450

[58] Field of Search ..... 362/252, 360, 217, 220, 362/450, 362, 427, 418, 277

[56] References Cited

U.S. PATENT DOCUMENTS 2,408,783 10/1946 Kloner ..... 362/219

*Primary Examiner*—Stephen J. Lechert, Jr.

[57] ABSTRACT

An extension, folding, or detachable lamp shade comprises a main shade and at least one auxiliary shades connected to the main shade but permitted to move with respect to the main shade. In one embodiment, the auxiliary shade is hinged to the main shade and may rotate with respect to the main shade. In another embodiment, the auxiliary shade is slidingly disposed in the main shade and may be retracted into the main shade. The lamp shade may thus be extended to a standard length for supporting a conventional fluorescent light tube, or reduced in length to facilitate packing and shipping.

In another embodiment the main and the auxiliary shades may be selectively detached from one another and then re-assembled together by means of a fastening member.

16 Claims, 14 Drawing Figures

EXTENSION, FOLDING OR DETACHABLE LAMP SHADE

SUMMARY OF THE INVENTION

This invention relates for a lamp shade that is convenient to packing and shipping; in particular, it is a special lamp shade that is an extension, folding, or detachable lamp shade so as to be reduced into a smaller dimensions for shipping convenience. The structure the lamp shade is described in detail by referring to the accompanying drawings as follows:

DESCRIPTION OF THE PREFERRED EMBODIMENT

Figure 1:
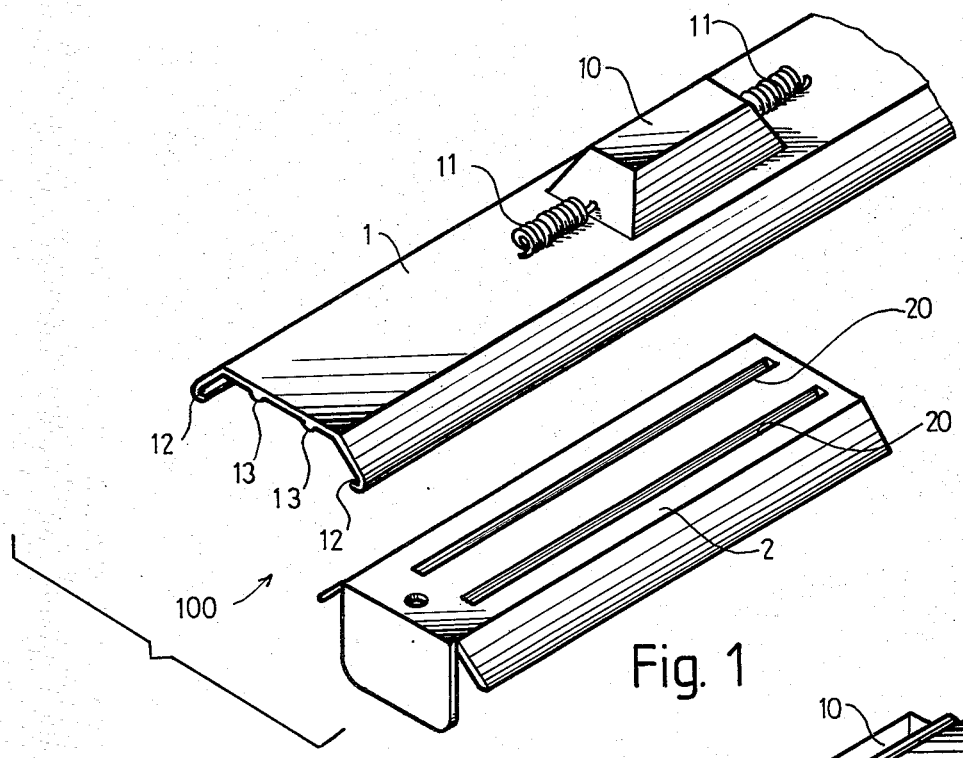
FIG. 1 is the partial perspective and exploded view of the embodiment of extension lamp shade in the present invention.
Figure 2:
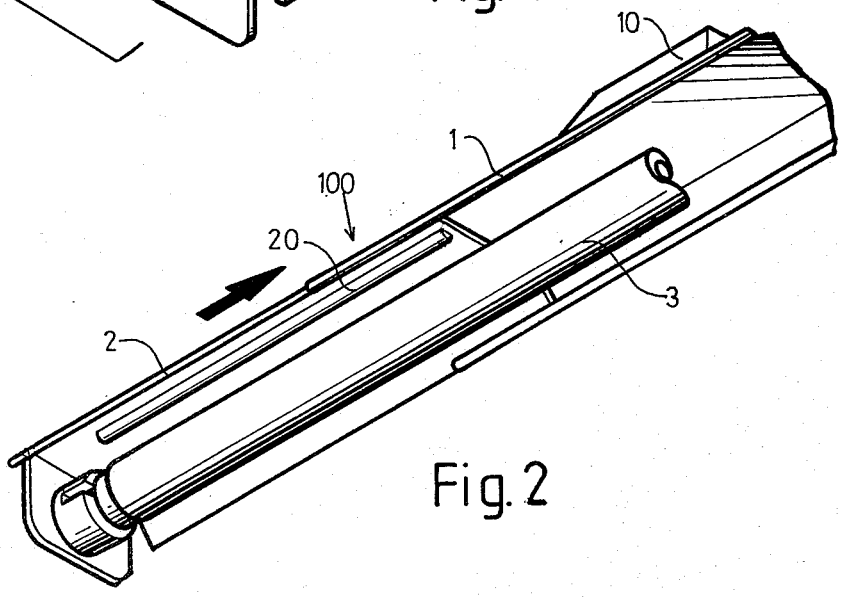
FIG. 2 is the perspective view of the extension lamp shade of FIG. 1 being unfolded.
Figure 3:
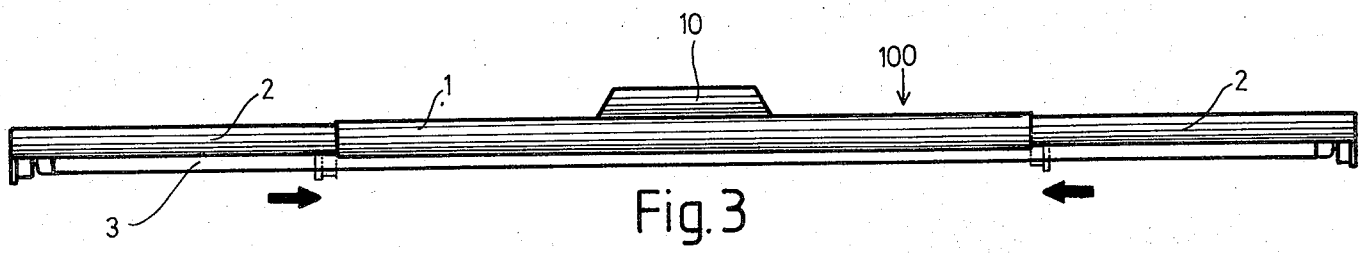
FIG. 3 is the front view of the extension lamp shade of FIG. 1 being unfolded.
Figure 4:
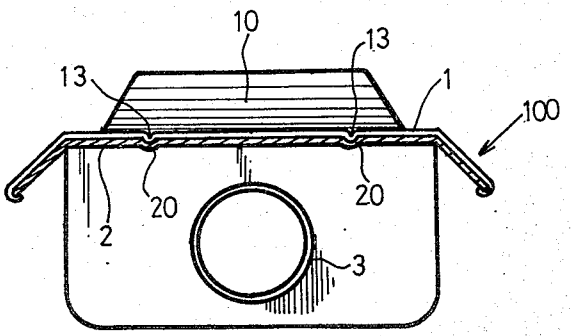
FIG. 4 is a sectional view of said extension lamp shade of FIG. 1 being unfolded.

Referring to FIGS. 1 and 2, there is shown a lamp shade 100 comprising a main shade (1) and an auxiliary shade (2). The main shade (1) includes a transformer (10) and a power supply wire (11) the length of which may be stretched. The two edges of the main shade (1) are bent inwards to form a guide groove (12) for holding the two edges of the auxiliary shade (2). On the top surface of the auxiliary shade (2), there are two guide grooves (20) which are in registration with the two guide pieces (13) at one end of the main shade (1). When the auxiliary shade (2) slides back and forth in the main shade (1), the guide pieces (13) will limit the extension length of the auxiliary shade so as to prevent it being separated from the main shade (1). When the auxiliary shade (2) is extended to its limit, the length of the whole lamp shade 100 is just equal to the length required for installing a standard fluorescent tube (3). As shown in FIG. 3, the length of the main shade (1) is twice that of the auxiliary shade (2). On the both ends of the main shade (1), an auxiliary shade (2) may be installed so that the total length of the lamp shade 100 is twice that of the main shade (1). Further, a single auxiliary shade (2) having a length equal to that of the main shade (1) may be pulled out of one end of said main shade (1) so as to form a two-section extension lamp shade.

Figure 5:
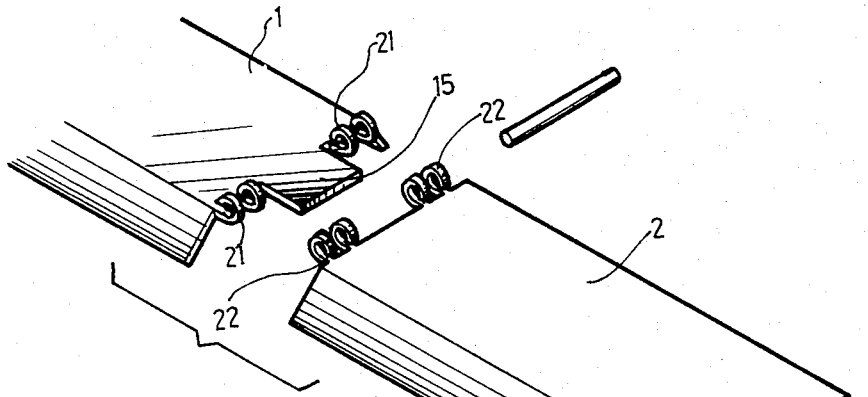
FIG. 5 is the perspective and exploded view of another embodiment of a lamp shade in accordance with the present invention which may be folded upwards.
Figure 7:
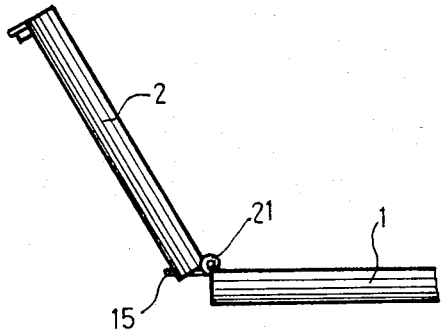
FIG. 7 is a partial front view of the embodiment of the lamp shade shown in FIG. 5 being folded upwards.
Figure 9:
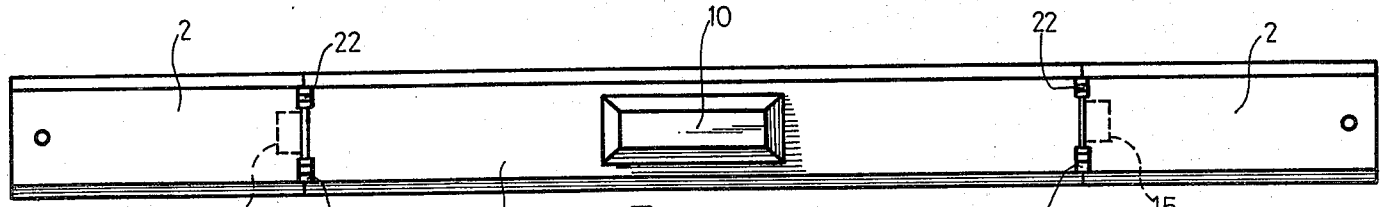
FIG. 9 is a top view of the embodiment of the lamp shade shown in FIG. 5.
Figure 10:
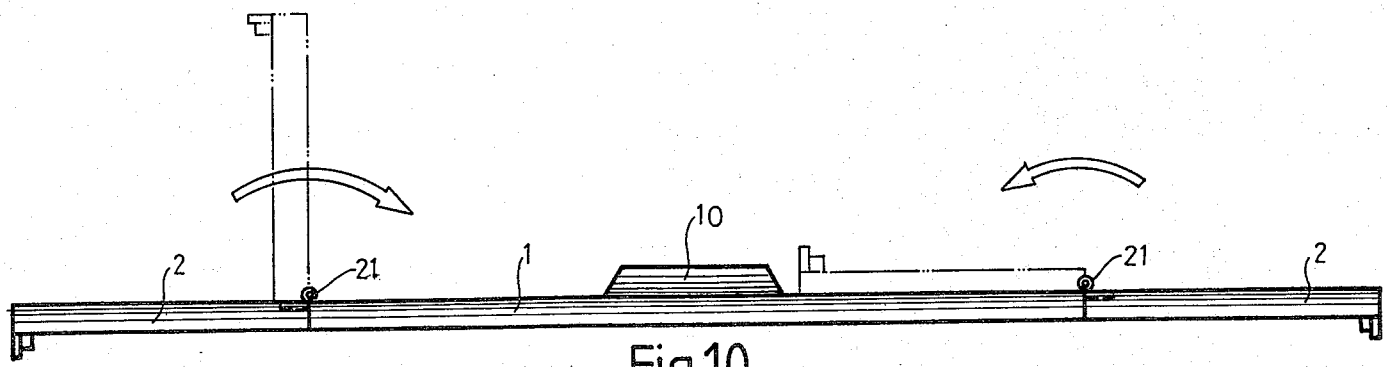
FIG. 10 is a side view of the embodiment of the lamp shade shown in FIG. 5 being folded upwards.

Referring to FIG. 5, there are shown two hinges (21) and (22) installed at the joint terminals of the main shade (1) and the auxiliary shade (2) respectively. When said hinges (21) and (22) are assembled together, the auxiliary shade (2) may be folded upwards over the top of the main shade (1) as shown in FIG. 7. In the center of the joint end of said main shade (1), a support plate (15) is furnished for supporting the weight and limiting the position of the auxiliary shade (2) when it is unfolded into a horizontal position as shown in FIGS. 9 and 10.

If the both ends of the main shade (1) are connected to an auxiliary shade (2), the transformer (10) should be positioned in the middle of the main shade (1), and the length of the auxiliary shade (2) at each end should be such as to not interfere with the transformer (10) when the auxiliary shades (2) are folded. If the main shade (1) is furnished with only one auxiliary shade (2) at one end, the transformer (10) may be installed away from the center of the main shade (1) and at the side of main shade 1 opposite the auxiliary shade (2) so as to have more space to install a longer auxiliary shade.

Figure 6:
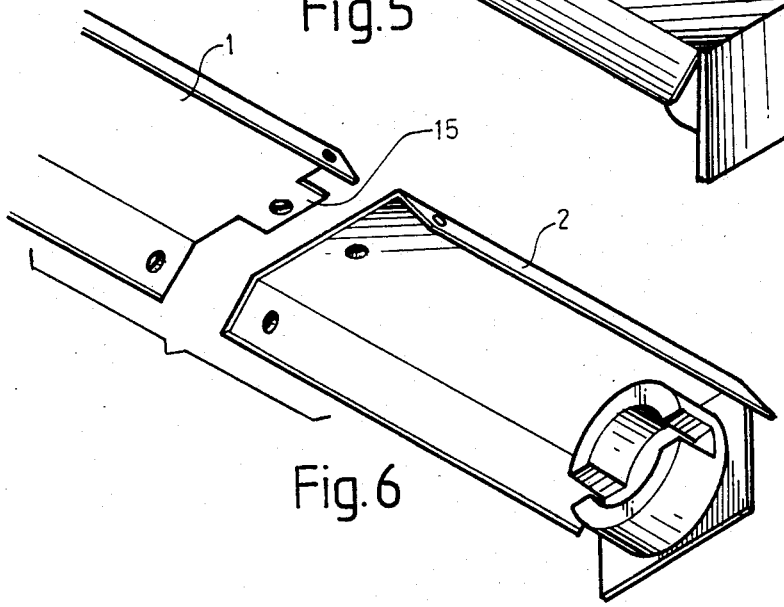
FIG. 6 is the perspective and exploded view of another embodiment of a lamp shade in accordance with the present invention which may be folded downwards.
Figure 8:
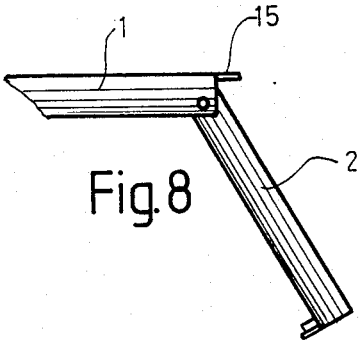
FIG. 8 is a partial front view of the embodiment of the lamp shade shown in FIG. 6 being folded downwards.
Figure 11:
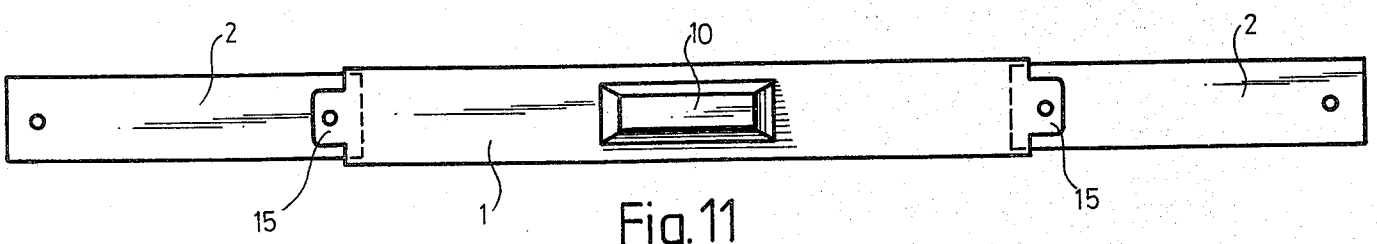
FIG. 11 is a bottom view of the embodiment of the lamp shade shown in FIG. 6.
Figure 12:
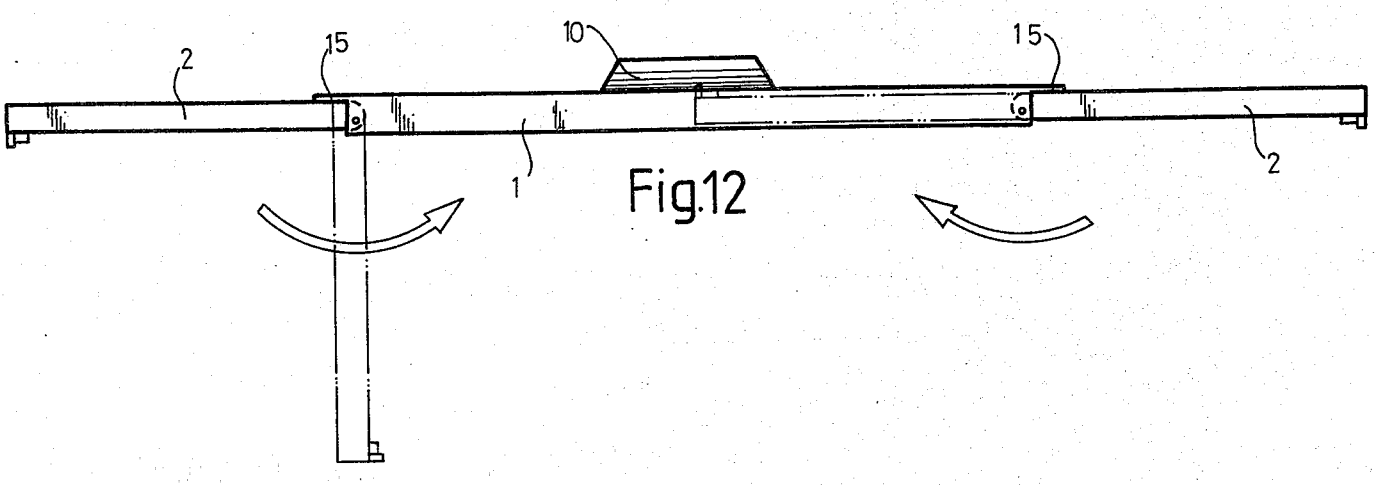
FIG. 12 is a side view of the embodiment of the lamp shown in FIG. 6 being folded downwards.

Referring to FIG. 6, the aforesaid folding lamp shade may also be designed so that the auxiliary shade (2) may be folded underneath the main shade (1), where the folding joint part between the main shade (1) and the auxiliary shade (2) is at the both edges of said shades. The stop plate (15) projected from the main shade (1) is used for limiting the position of the auxiliary shade (2) when it is unfolded to horizontal position as shown in FIG. 8. Main shade 1 and auxiliary shade 2 two are fixed together in a straight line by means of the stop plate (15) and the positioning means or special fasteners to accept a standard fluorescent tube (3). In the embodiment the auxiliary shade (2) is to be folded underneath the main shade (1); therefore, the auxiliary shade (2) will not interfere with the transformer (10). Further, the shipping dimensions of the shades after being folded become smaller as shown in FIGS. 11 and 12.

Figure 13:
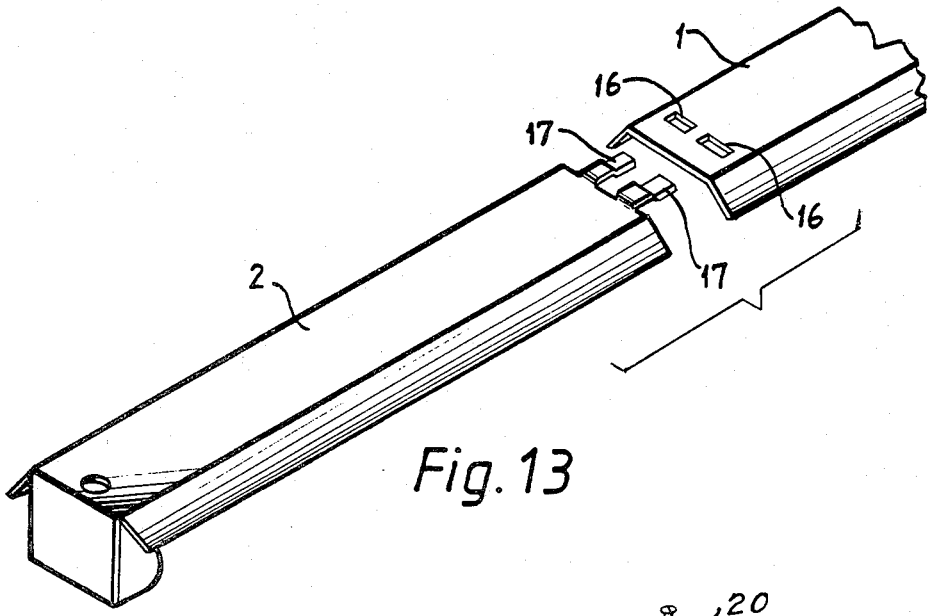
FIG. 13 is the perspective and exploded view of another embodiment of a lamp shade in accordance with the present invention wherein the lamp shade is detachable by means of fastener means.
Figure 14:
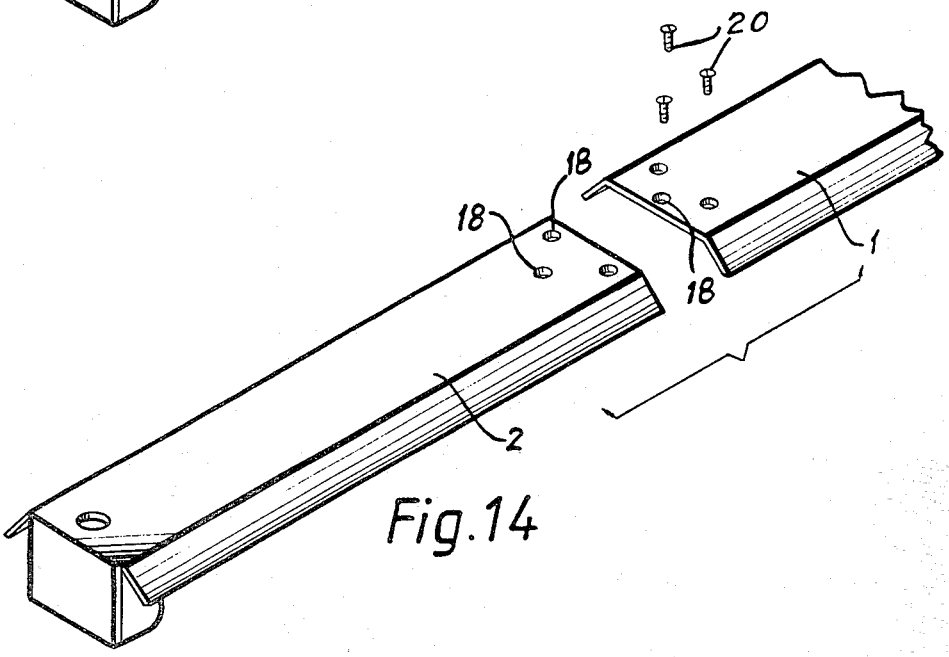
FIG. 14 is the perspective and exploded view of another embodiment of a detachable type of lamp shade in accordance with the present invention wherein the lamp shade is detachable by means of bolt screws.

Another feature of said lamp shade structure is that the main shade (1) and the auxiliary shade (2) may be diassembled for shipping, and reassembled during use as shown in FIGS. 13 and 14. Referring to FIG. 13, one end of the main shade (1) is furnished with two or more fastening holes (16), while one end of the auxiliary shade (2) is furnished with two or more fastening pieces (17). By means of said fastening pieces (17), the auxiliary shade (2) may be attached to the main shade (1). Referring to FIG. 14 the main shade (1) and the auxiliary shade (2) may be connected together by furnishing a number of screw holes (18), or rectangular apertures and by using a positioning element 20 (suitably plural sheet-metal screws) to fix, or adjustably fix the shades.

I claim:

1. A folding lamp shade structure for supporting and providing power to a conventional fluorescent light tube comprising:

a main lamp shade having first and second ends;

at least one auxiliary lamp shade;

connecting means for rotatably connecting a first end of said auxiliary lamp shade to said first end of said main lamp shade, said connecting means permitting said auxiliary lamp shade to rotate between at least a first and a second position, said auxiliary shade not adding to the axial length of said lamp shade structure when in said first position, the length of said lamp shade structure being substantially equal to the length of said conventional fluorescent light tube when said auxiliary shade is in said second position;

a plurality of fluorescent tube connecting socket means, at least one being attached to a second end of said auxiliary shade and at least one being attached to said second end of said main lamp shade, for physically retaining and for coupling electric power to said light tube;

electrical transformer means for providing an electrical supply voltage; and extensible electrical connecting means for flexibly electrically coupling said fluorescent tube socket means to said transformer means.

2. A folding lamp shade structure as in claim 1 wherein said auxiliary shade lies in the same plane as said main shade when in said second position and is rotated 180 degrees beyond the plane of said main shade when in said first position.

3. A folding lamp shade structure as in claim 2 further comprising a narrow stop plate projecting from said first end of said main shade to support said auxiliary shade in said second position.

4. A folding lamp shade structure for supporting and providing power to a conventional fluorescent light tube comprising:

a main lamp shade having first and second ends;

first and second auxiliary lamp shades;

connecting means for rotatably connecting a first end of said first auxiliary lamp shade to said first end of said main lamp shade and a first end of said second auxiliary lamp shade to said second end of said main lamp shade, said connecting means permitting said auxiliary lamp shades to rotate between at least a first and a second position with respect to said main shade, said auxiliary shades not adding to the axial length of said lamp shade structure when in said first position, the length of said lamp shade structure being substantially equal to the length of said conventional fluorescent light tube when said auxiliary shades are both in said second position;

a plurality of fluorescent tube connecting socket means, at least one attached to a second end of each of said auxiliary lamp shades, for physically retaining and for coupling electric power to said fluorescent light tube;

electrical transformer means for providing an electrical supply voltage; and extensible electrical connecting means for electrically coupling said fluorescent tube connecting socket means to said transformer means.

5. A folding lamp shade structure as in claim 4 wherein said auxiliary shades lie in the same plane as said main shade when in said second position, and are provided 180 degrees beyond the plane of said main shade when in said first position.

6. A folding lamp shade structure as in claim 5 further comprising a narrow stop plate projecting from each of said ends of said main shade to support said auxiliary shades in said second position.

7. An extension lamp shade structure for supporting and providing power to a conventional fluorescent light tube comprising:

a main lamp shade;

at least one auxiliary lamp shade disposed within said main lamp shade for sliding rectilinear movement within said main lamp shade;

a plurality of fluorescent tube connecting socket means, at least one attached to a first end of said auxiliary shade and at least one attached to a first end of said main shade, for physically retaining and for supplying electric power to said fluorescent light tubes;

electrical transformer means for providing an electrical voltage; and extensible electrical connecting means for electrically coupling said connecting socket means to said transformer means.

8. An extensible lamp shade structure as in claim 7 wherein there are two auxiliary lamp shades.

9. A lamp shade structure as in claim 3 wherein said positioning member is a threaded screw.

10. An extension lamp shade structure as claimed in claim 7, wherein said main lamp shade comprises a sheet of material having two edges which are bent inwards to form a guide groove for retaining said auxiliary shade as it slides.

11. An extension lamp shade as in claim 7 further comprising a guide piece means extending from said main shade for limiting the degree which said auxiliary shade may extend from said main shade.

12. An folding lamp shade as in claim 2, wherein said auxiliary shade will not interfere with said transformer means when said auxiliary shade is in said first position.

13. An extension lamp shade structure as in claim 7 further comprising selectively engagable fastening means for rigidly, fixedly connecting said main and the auxiliary shades together to form a single straight unit.

14. A lamp structure as in claim 13, wherein said main shade and said auxiliary shade each have a wall defining at least one hole, said hold of said main shade being in registration with said hole of said auxiliary shade when said auxiliary shade is slid with respect to said main shade to a position where the length of said lamp shade structure is substantially equal to the length of said fluorescent light tube; and wherein said fastening means comprise a positioning member which may be selectively inserted into said holes.

15. A folding lamp shade structure as in claim 1, wherein said transformer means is attached near said first end of said main shade.

16. A folding lamp shade structure as in claim 1, wherein said transformer means is attached near said second end of said main shade.

* * * * *